United States Patent [19]

Rioja et al.

[11] Patent Number: 4,927,469

[45] Date of Patent: May 22, 1990

[54] ALLOY TOUGHENING METHOD

[75] Inventors: Roberto J. Rioja; Diana K. Denzer, both of Lower Burrell, Pa.

[73] Assignee: Aluminum Company of America, Pittsburgh, Pa.

[21] Appl. No.: 180,623

[22] Filed: Apr. 11, 1988

Related U.S. Application Data

[63] Continuation of Ser. No. 860,546, May 7, 1986, abandoned, which is a continuation-in-part of Ser. No. 735,567, May 17, 1985, abandoned.

[51] Int. Cl.[5] ..... C22F 1/04

[52] U.S. Cl. ..... 148/11.5 A; 148/11.5 P; 148/437

[58] Field of Search ..... 148/13.1, 13, 126, 11.5 P, 148/11.5 A, 437, 415

[56] References Cited

U.S. PATENT DOCUMENTS 4,347,076 8/1982 Ray et al. ..... 75/0.5 R
4,379,719 4/1983 Hildeman et al. ..... 419/60

OTHER PUBLICATIONS

Jones, H., "Observations on a Structural Transaction in Aluminium Alloys Hardened by Rapid Solidification", Mater. Sci. Eng, 5 (1970), pp. 1–18.

Chu et al., "Microstructural Evolution Having Solidification of Al–Fe–Ce Powder", Proc. 43rd Annual Meeting of Electron Microscopy Society of Amer © 1985, San Francisco Press, pp. 32–33.

Staley, J. T., "Microstructure and Toughness of High Strength Aluminum Alloys", Properties Related to Fracture Toughness, ASTM STP605, p. 1976, pp. 71–103.

*Primary Examiner*—R. Dean

*Attorney, Agent, or Firm*—Daniel A. Sullivan, Jr.

[57] ABSTRACT

A method of treating a metallurgical object containing metastable featureless regions adversely affecting toughness, comprising heating the object for transforming the regions at least sufficiently out of their metastable state to improve toughness.

A method of treating metal particles containing metastable featureless regions which adversely affect toughness when the particles are bonded together to form a metallurigcal object, comprising heating the particles for transforming the regions at least sufficiently out of their metastable state to improve toughness in metallurgical objects formed by bonding the particles together.

50 Claims, 4 Drawing Sheets

FIG. 1: As Atomized Powder S No. 514283 (Al-7% Fe-6.2% Ce)
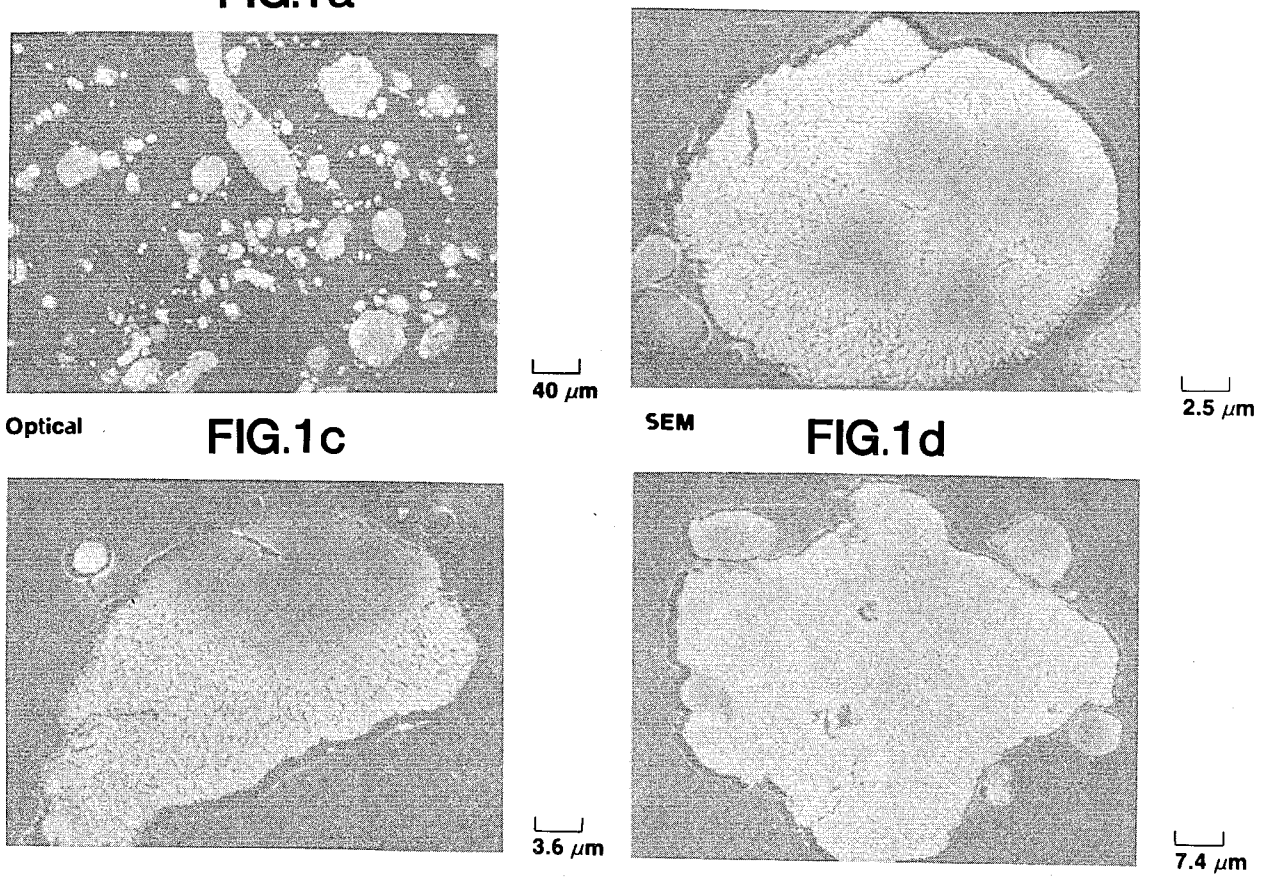

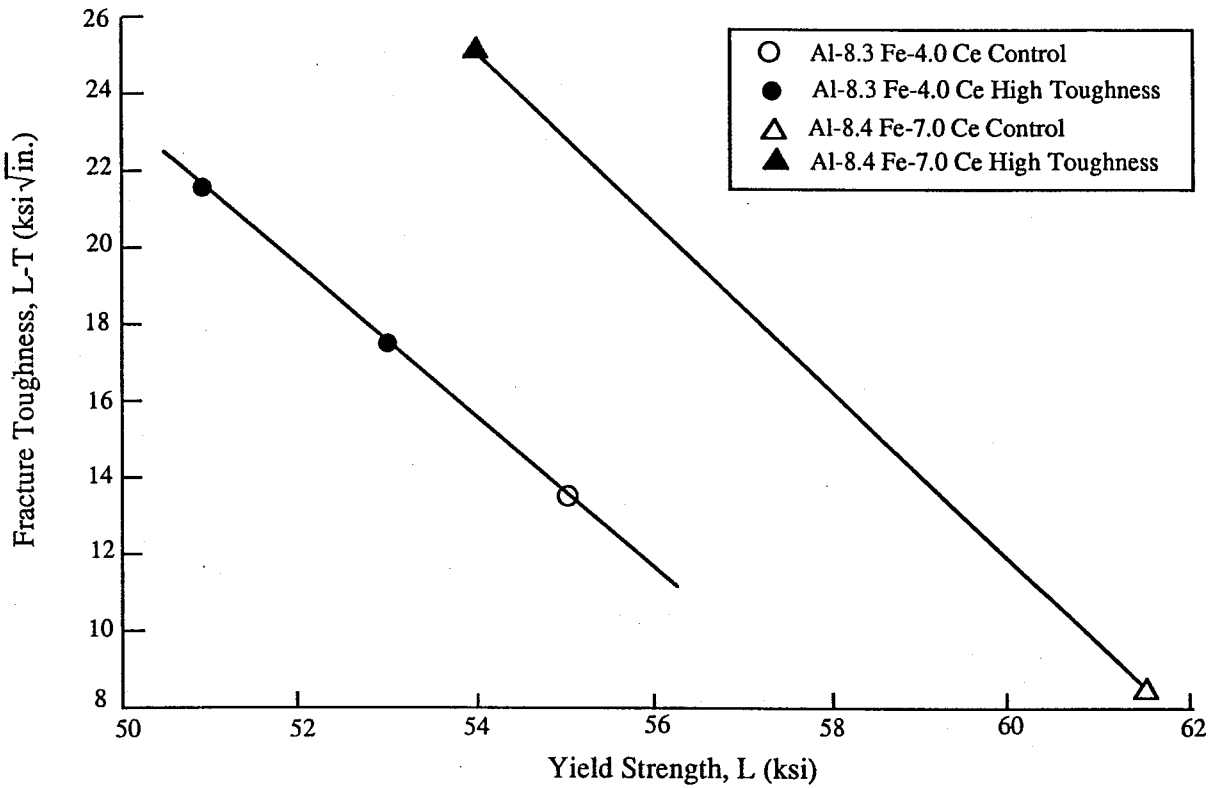
Figure 2: Fracture Toughness as a Function of Yield Strength 5.1 X 10.2 cm (2.0 X 4.0 in.) Extrusions

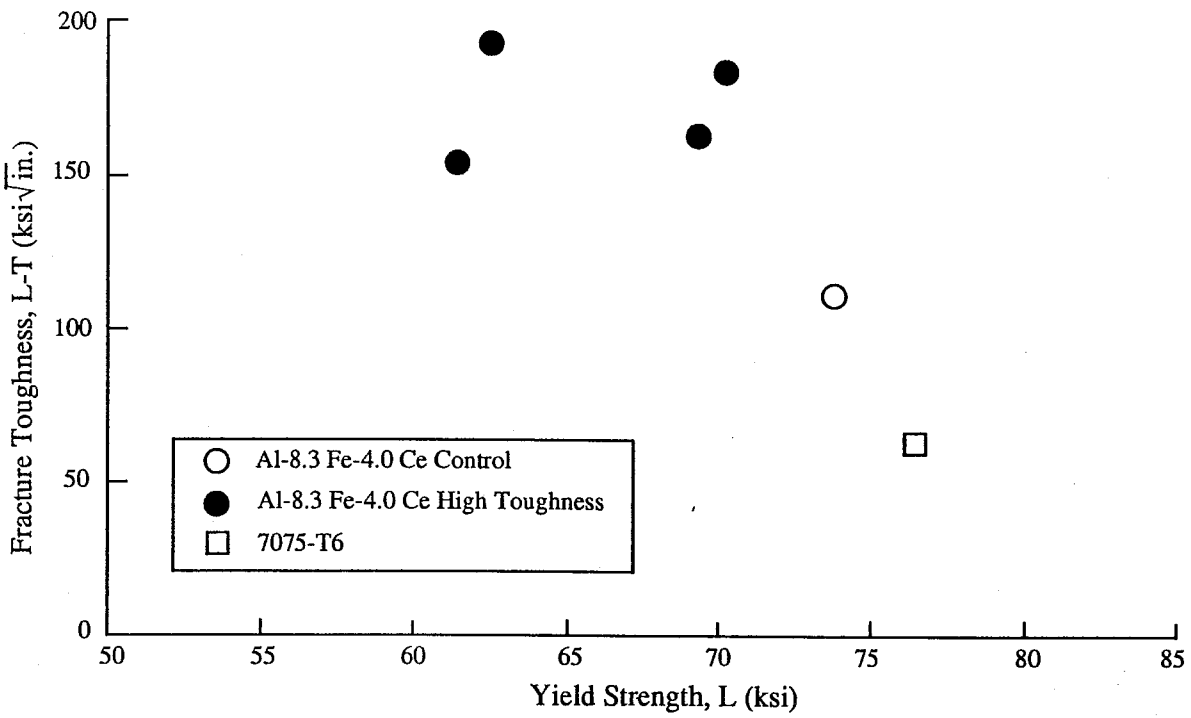
Figure 3: Fracture Toughness as a Function of Yield Strength 1.60 mm (0.063 in.) Sheet

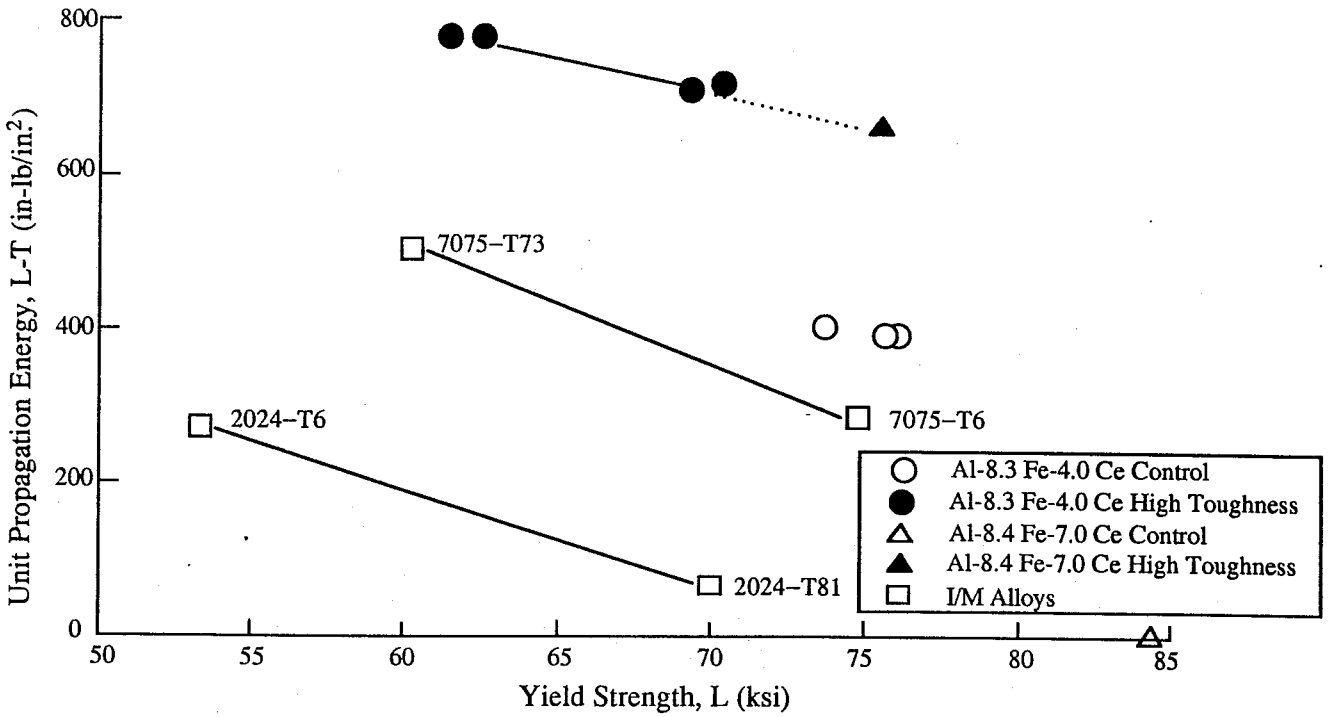
Figure 4: Unit Propagation Energy as a Function of Yield Strength 1.60 mm (0.063 in.) Sheet

ALLOY TOUGHENING METHOD

CROSS-REFERENCE TO RELATED APPLICATION

This is a continuation of U.S. patent application Ser. No. 860,546 filed May 7, 1986, abandoned which is a continuation-in-part of U.S. patent application Ser. No. 735,567 filed May 17, 1985, abandoned.

BACKGROUND OF THE INVENTION

Mettalurgical objects produced from rapidly cooled metal have been burdened by low toughness. the cause of this low toughness was not known.

SUMMARY OF THE INVENTION

It is an object of the invention to provide a method for toughening metallurgical objects produced from rapidly cooled metal components.

We have discovered that metastable, featureless regions in rapidly cooled metal adversely affect toughness.

We achieve this as well as other objects which will become apparent from the discussion that follows, according to the present invention, by providing: a method of treating a metallurgical object containing metastable featureless regions adversely affecting fracture toughness, comprising heating the object for transforming the regions at least sufficiently out of their metastable state to improve fracture toughness; and, a method of treating metal particles containing metastable featureless regions which adversely affect fracture toughness when the particles are bonded together to form a metallurgical object, comprising heating the particles for transferring the regions at least sufficiently out of their metastable state to improve fracture toughness in metallurgical objects formed by bonding the particles together.

BRIEF DESCRIPTION OF THE DRAWINGS

FIG. 1, composed of FIGS. 1*a* to 1*d*, are photomicrographs of a powder used in the invention.

FIGS. 2 to 4 are plots of data.

DETAILED DESCRIPTION

Featureless Regions

The present invention concerns a treatment of metallurgical objects containing certain metastable, featureless regions. The treatment improves fracture toughness.

Instances in the literature where the term "featureless" is used to refer to these regions are as follows:

| Location in Reference | Citation of Reference |
|---|---|
| Col. 4, line 21 | U.S. Pat. No. 3,899,820, 8/19/85 |
| E.g. lines 7&8, abstract | RapidlyQu'dMetalsIII,1,73-84,1978 |
| E.g., the title | Met.Trans.A,V.15A,1/84,pp29-31 |
| Intro.,2nd.para.,line2 | Scrip.Met'ica,V18,1984,pp905-9 |
| Intro.,2nd.para.,line6 | Scrip.Met'ica,V18,1984,pp911-6 |
| E.g., page 26 | MatResSocSympProc,V28,1984,pp21-7 |
| Pg. 148, top left col. | Mat.Sci.&Eng.,V65,1984,pp145-56 |
| 3rd.para.,line2 | 43rdAnMt'gElecM'scopSoc,'85,pp32-3 |

These featureless regions are crystalline. This is evident alone in the title of the second-listed reference, "Rapidly Quenched Crystalline Alloys". It is also evident from what is believed to be the pioneer article on these regions, entitled "Observations on a Structural Transition in Aluminum Alloys Hardened by Rapid Solidification" by H. Jones, *Mater. Sci. Eng.*, 5 (1969/70), pp. 1-18. Thus, in the Summary of the article by Jones, reference is to X-ray diffraction alpha-Al line broadening, and shift, in zone A regions ("zone A regions" is synonymous to "featureless regions", as can be observed, for instance, in the references antedating Jones, as cited in the preceding paragraph), such indicating that discussion is of crystalline material.

The featureless regions result from rapid cooling. FIG. 1 illustrates the phenomenon of featureless regions. In FIG. 1*a*, taken using optical microscopy, the featureless regions appear white as compared to the other regions which have a texture that appears to be black specks on a gray background. Note that the smaller particles tend to be completely featureless, an effect of the higher cooling rate experienced by the smaller particles. The scanning electron microscopy photographs of FIGS. 1*b*–1*d* further illustrate the featureless regions, which appear uniformly gray as compared to the remaining, dendritically textured regions. FIGS. 1*b* and 1*d* show again the smaller, completely featureless regions. FIG. 1*c* shows in particularly good detail that the particle has a featureless half-moon region on its lower side. This is an aspect which also shows in FIGS. 1*a*and 1*b*, namely that higher cooling rates in some parts of a particle versus slower cooling rates in other parts can lead to a situation where the particle will be featureless in the rapidly cooled parts and textured in the slower cooled parts.

Alloys

In general, any alloy containing featureless regions can be treated according to the invention.

A preferred Al alloy consists essentially of 4 to 12% Fe, 2 to 14% Ce, remainder Al. Fe combines with Al to form intermetallic dispersoids and precipitates providing strength at room temperature and elevated temperature. Ce combines with Fe and Al to form intermetallic dispersoids which provide strength, thermal stability and corrosion resistance. Further information concerning this alloy is contained in U.S. Pat. Nos. 4,379,719 and 4,464,199.

Uniformizing

With respect to strength, such as yield or tensile strength, our uniformizing heat treatment, within the featureless regions, represents an overaging.

This heating step of the invention for the above preferred Al alloy will generally be in the range 750°-950° F. for 10 seconds to 4 hours. However, at lower temperatures, longer time may be suitable. This could be of advantage in the case of large billets, in order obtain temperature uniformity.

Fast heating appears to be best (via induction heating), since this will prevent coarsening, for instance dispersoid coarsening.

Deformation

In the heating to effect the uniformizing of the invention, the featureless particles are stabilized and they become deformable. Deformation after the uniformizing treatment, for instance deformation in the form of compaction, extrusion or rolling, will provide a more uniform microstructure, with improved bonding between powder particles. Improved interparticle powder bonding further increases toughness and resistance to crack propagation.

Illustration

The following Table A illustrates results achieved by procedure according to the present invention (with heat treatment, i.e. 1 to 3 minutes at 900° F. followed by cooling to 725° F. extrusion temperature) compared to results without heat treatment (i.e. the billet was heated directly to the 725° F. extrusion temperature and then extruded). Processing in going from extruded bar to sheet was the same in both instances.

TABLE A

| | Comparative Examples | | | |
|---|---|---|---|---|
| | With Heat Treatment[a] | | Without Heat Treatment | |
| | Toughness[b] | Strength[b] | Toughness[b] | Strength[b] |
| Extrusions | 21.4 | 50.9 | 13.7 | 55.1 |
| Sheet | 720[c] | 70.2 | 405[c] | 73.7 |

[a]1 min at 900° F.
[b]Toughness = Ksi · in $^{\frac{1}{2}}$, Strength = Ksi
[c]Sheet toughness given in unit propagation energy (UPE) in-lb/in$^2$ In the case of the extrusion, there was a 56% increase in toughness for an 8% decrease in yield strength. For the sheet, toughness was increased 78% for an 5% decrease in yield strength.

Advantages

The invention improves toughness and thermal stability in metallurgical objects based on rapid solidification processes. It is expected that creep behavior will also be improved.

Further illustrative of the invention are the following examples.

Example I

Rapidly solidified aluminum alloy powder of composition 8.4% Fe, 4.0% Ce, rest essentially aluminum, had featureless regions resulting from rapid cooling during formation of the powder. To make the powder, a pot of such composition was alloyed by adding high purity alloying elements to high purity aluminum. The melt was passed through a filter and atomized using high temperature flue gas to minimize the oxidation of the alloying elements. During atomization, the powder was continuously passed through a cyclone to separate the particles from the high velocity air stream. The majority of powder particles had diameters between 5and 40 micrometers. Powder was screened to retain only less than 74 micrometers size powder and fed directly into a drum. Besides Fe, Ce, and Al, the powder had the following percentages of impurities: Si 0.14, Cu 0.02, Mn 0.04, Cr 0.01, Ni 0.02, Zn 0.02, Ti 0.01. The powder was found to have featureless regions in about the same quantity and distribution as shown in FIG. 1. The particle size distribution of the powder was 4.4% in the range 44 to 74 micrometers and 95.4% smaller than 44 micrometers. Average particle diameter was 15.5 microns as determined on a Fisher Subsieve Sizer.

Billet was made from this powder by cold isostatic pressing to approximately 75% of theoretical density. Each 66 kg (145 lb) cold isostatic compact was encapsulated in an aluminum container with an evacuation tube on one end. The canned compacts were placed in a 658 K (725° F.) furnace and continuously degassed for six hours, attaining a vacuum level below 40 microns. Degassed and sealed compacts were then hot pressed at 725° F. to 100 percent density using an average pressure of 469.2 MPa (68 ksi).

A cylindrical extrusion charge measuring 15 cm (6.125 in.) diameter ×30.5 cm (12 in.) length was machined from the billet and subjected to a uniformizing treatments of 1 minute at 850° F. and 1 minute at 900° F. Heating was done using an induction furnace operating at 60 $H_z$. Temperature was measured by a thermocouple placed at an axial location about 1.2 cm (0.5 in.) from the end. It took about 10 minutes to heat the extrusion charge from room temperature to 850° F. or 900° F. at which point temperature was controlled at 850° F. and 900° F. for the 1 minute holding time.

The extrusion charge was then air-cooled to 725° F. and extruded as a bar of 5 cm (2 inches) ×10 cm (4 inches) cross section.

Another Al-Fe-Ce alloy having the composition Al-8.4% Fe-7.0% Ce was also uniformized at 900° F. for 1 min.

Properties for both alloys are recorded in Table I. Results from Table I are shown graphically in FIG. 2. Note the strength toughness relation for the two different alloys.

TABLE I

Room Temperature Tensile and Fracture Toughness Test Results of Extrusions

| | | Uniformizing Treatment | | Yield Strength 0.2% Offset | | Tensile Strength | | Elongation | Fracture Toughness | |
|---|---|---|---|---|---|---|---|---|---|---|
| Sample No.[a] | Alloy | Temp. °F. | Time Min. | MPa | (Ksi) | MPa | (Ksi) | (%) | MPa · m$^{\frac{1}{2}}$ | (Ksi · in$^{\frac{1}{2}}$) |
| 514295-1B | Al—8.4 Fe—4.0 Ce | Control | | 388 | (56.2) | 497 | (72.0) | 12.5 | 14.7 | (13.4) |
| 514282-1 | Al—8.4 Fe—4.0 Ce | Control | | 380 | (55.1) | 469 | (68.0) | 9.6 | 15.1 | (13.7) |
| 514412-T | Al—8.4 Fe—4.0 Ce | 850 | 1 | 366 | (53.0) | 449 | (65.0) | 17.8 | 19.6 | (17.8) |
| 514413-1B | Al—8.4 Fe—4.0 Ce | 900 | 1 | 351 | (50.9) | 425 | (61.6) | 16.7 | 23.5 | (21.4) |
| 514398-2T | Al—8.4 Fe—7.0 Ce | Control | | 426 | (61.7) | 530 | (76.8) | 11.0 | 9.35 | (8.5)[c] |
| 514416-2T | Al—8.4 Fe—7.0 Ce | 900 | 1 | 373 | (54) | 450 | (65.2) | 16.0 | 27.8 | (25.3) |

Notes:
Values are averages from duplicate tests. Yield and tensile strengths were measured in the longitudinal (L) direction using 0.907 cm (0.357") diameter specimens machined from the extruded product. Elongation was measured in a 3.56 cm (1.40") gauge length. Tensile properties were obtained according to ASTM B557. Fracture toughness was measured in the L-T orientation using compact tension specimens of size 1.90 cm (0.75") thick × 3.81 cm (1.50 m) × 4.57 cm (1.80").
[a]Product size: 5.1 cm × 10.2 cm (2.0 in. × 4.0 in.)
[b]Values are Kic per ASTM E399.
[c]This value was not a valid Kic but a meaningful value per ASTM B645

Example II

Extruded bar of Example I was rolled at 600° F. to sheet of final thickness equalling 1.60 mm (0.063 inch).

Prior to rolling, the extrusion was sawed to approximately 25 cm (10 in.) lengths. Surface roughness, caused by pickup of aluminum on the extrusion dies, was eliminated by machining the extrusions to the thicknesses listed in Table III. Also listed are process parameters used to roll the Al-Fe-Ce 1.60 mm (0.063 in.) sheet.

Each piece was cross rolled until the desired width, greater than 41 cm (16 inches), was obtained, followed by straight rolling to the desired thickness, 1.60 mm (0.063 inch).

1.27 cm (0.5 in.) width ×5.08 cm (2.0 in.) gage length tensile specimens were prepared and tested to give results as shown in Table II. Sheet tensile strength was determined per ASTM E8 and E23. The Alcoa-Kahn tear test (see "Fracture Characteristics of Aluminum Alloys, " J. G. Kaufman, Marshall Holt, Alcoa Research Laboratories, Technical Paper No. 18, pp. 10–18, 1965) and fracture toughness $K_c$ per ASTM B646 and E561 were used to compare sheet toughness. These results are shown in Table II. FIG. 3 shows the graphic representation of the strength/fracture toughness, $K_c$, relationships for representative samples of Table II, while FIG. 4 provides a corresponding presentation from Table II in the form of toughness indicator, or unit propagation energy, against yield strength. The superiority of sheet treated according to the present invention compared to the ingot metallurgy representatives is apparent.

It is to be noted that for a given alloy, the tradeoff between strength loss and toughness improvement is a function of time and temperature during the uniformizing treatment.

TABLE II

Room Temperature Tensile and Fracture Toughness 1.60 mm (0.063 in.) Sheet

| Sample No.[a] | Alloy | Treatment Temp °F. | Treatment Time Min. | Yield Strength MPa | Yield Strength Ksi | Tensile Strength MPa | Tensile Strength Ksi | Elongation % | Tear Test kJ/m² | Tear Test in.-lb/in.² | Fracture Toughness, kc MPa $\sqrt{m}$ | Fracture Toughness, kc Ksi $\sqrt{in}$ | Valid[h] |
|---|---|---|---|---|---|---|---|---|---|---|---|---|---|
| 514295-2B | Al—8.3Fe—4.0Ce | Control | | 508 | 73.7 | 546 | 79.1 | 6.8 | 70.9 | 405[b] | 122.7 | 111.7 | Yes |
| 554314 | Al—8.3Fe—4.0Ce | Control | | 523 | 75.8 | 575 | 83.4 | 10.0 | 68.9 | 395 | | | |
| 514388-2 | Al—8.3Fe—4.0Ce | Control | | 524 | 76.0 | 561 | 81.3 | 6.5 | 69.2 | 395[f] | | | |
| 514412-BR | Al—8.3Fe—4.0Ce | 850 | 10 | 477 | 69.2 | 513 | 74.3 | 5.8 | 125.6 | 715[c] | 180.8 | 164.5 | No |
| 514413-1BR | Al—8.3Fe—4.0Ce | 900 | 1 | 484 | 70.2 | 518 | 75.1 | 6.0 | 125.7 | 720[d] | 191.2 | 174.0 | No |
| 514408-2BR | Al—8.3Fe—4.0Ce | 900 | 10 | 424 | 61.6 | 460 | 66.7 | 8.0 | 135.5 | 775 | 168.1 | 153.0 | No |
| 554311 | Al—8.3Fe—4.0Ce | 850 | 60 | 432 | 62.6 | 483 | 70.0 | 10.0 | 135.5 | 775 | 214.5 | 195.0 | No |
| 514398-2T | Al—8.4Fe—7.0Ce | Control | | 579 | 84.1 | 622 | 90.2 | 6.5 | 0 | 0[g] | | | |
| 514416-2TR | Al—8.4Fe—7.0Ce | 900 | 1 | 519 | 75.4 | 549 | 79.6 | 8.2 | 117.3 | 670[e] | 98.9 | 90.0 | Yes |
| | 7075-T6 | — | — | 517 | 74.9 | 568 | 82.3 | 11.2 | 50.7 | 290 | 70.8 | 64.4 | Yes |
| | 7075-T73 | — | — | 416 | 60.3 | 494 | 71.6 | 10.6 | 89.2 | 510 | — | — | |
| | 2024-T81 | — | — | 482 | 69.8 | 512 | 74.2 | 6.6 | 29.7 | 170 | — | — | |
| | 2024-T6 | — | — | 367 | 53.2 | 464 | 67.2 | 9.2 | 48.1 | 275 | — | — | |

NOTES:

[a]All tests were done in the L-T orientation. Sheet thickness varies from 1.60 to 1.78 mm (0.063" to 0.070") except 554311 which has a nominal thickness of 1.42 mm (0.056").

Al—Fe—Ce tensile and tear test results are averages of duplicate tests, Kc results are single tests. 7075 and 2024 results are averages of 2–10 tests.

[b]One of the duplicates underwent rapid & diagonal fracture (UPE may be estimated and slightly high; included in average).

[c]Both tests: diagonal fracture (tear strength and UPE may be slightly high; included in average).

[d]One of the duplicates underwent diagonal fracture (tear strength and UPE may be slightly high; included in average).

[e]One of the duplicates underwent rapid fracture (UPE was estimated, but not included in average shown).

[f]One test: rapid and diagonal fracture - curve not reliable (energy near zero; not included in average shown).

[g]Crack growth was unstable.

[h]Invalidities are due to specimen size, i.e., specimen was not large enough to provide enough recoverable elastic energy to produce unstable crack growth in an elastic-stress field.

Specimen Sizes:

Tensile: Sheet thickness × 1.27 cm (0.5") wide specimen. Elongation was measured in 5.08 cm (2.0") gauge length.

Tear Test: Kahn-type, sheet thickness × 3.65 cm (1.44") × 5.72 cm (2.25").

Fracture Toughness: Center-crack, sheet thickness × 40.6 cm (16.0") × 111.8 cm (44.0").

TABLE III

Process Parameters Used To Roll 1.60 mm (0.063 in.) Al—Fe—Ce Sheet

| Sample No. | Rolling Temperature K. | Rolling Temperature F. | Extrusion Thickness cm | Extrusion Thickness in. | Sheet Thickness mm | Sheet Thickness in. |
|---|---|---|---|---|---|---|
| 514295-2B | 589 | 600 | 4.72 | 1.86 | 1.59 | 0.0625 |
| 554314 | 616/589 | 650/600* | 4.45 | 1.75 | 1.55 | 0.061 |
| 514388-2 | 589 | 600 | 2.51 | 0.988 | 1.65 | 0.065 |
| 514412-BR | 589 | 600 | 5.08 | 2.0 | 1.68 | 0.066 |
| 514413-1BR | 589 | 600 | 5.08 | 2.0 | 1.69 | 0.0665 |
| 514408-2BR | 589 | 600 | 5.08 | 2.0 | 1.70 | 0.067 |
| 554311 | 616/589 | 650/600* | 4.45 | 1.75 | 1.37 | 0.054 |
| 514398-2T | 589 | 600 | 4.65 | 1.83 | 1.54 | 0.0605 |
| 514416-2TR | 589 | 600 | 4.76 | 1.875 | 1.60 | 0.063 |

*Extrusions were heated to 616° K. (650° F.) for the first rolling reductions and 589° K. (600° F.) for subsequent reductions.

Unless noted otherwise, percentages herein are on a weight basis.

While the invention has been described in terms of preferred embodiments, the claims appended hereto are intended to encompass all embodiments which fall within the spirit of the invention.

What is claimed is:

1. A method of treating a metallurgical object containing metastable, crystalline, featureless regions adversely affecting toughness, comprising heating the object for transforming the regions at least sufficiently out of their metastable state to stabilize them and make them deformable, and deforming the object following the heating to improve toughness as compared to that achieved without the heating.

2. A method as claimed in claim 1, the heating being sufficient to provide at least a 10% improvement in toughness.

3. A method as claimed in claim 1, the heating being sufficient to provide at least a 20% improvement in toughness.

4. A method as claimed in claim 1, the heating being sufficient to provide at least a 30% improvement in toughness.

5. A method as claimed in claim 1, the object comprising an aluminum alloy.

6. A method as claimed in claim 5, the object comprising an aluminum alloy of the class referred to as non-heat treatable or dispersion hardened.

7. A method as claimed in claim 6, the object comprising bonded powder.

8. A method as claimed in claim 7, the object comprising a dispersion hardened, bonded powder.

9. A method as claimed in claim 8, the alloy consisting essentially of 4 to 12% iron, 1 to 8% rare earth metal, balance aluminum.

10. A method as claimed in claim 9, the alloy consisting essentially of 6 to 10% iron, 2 to 7% cerium, balance aluminum.

11. A method of treating metal particles containing metastable, crystalline, featureless regions which adversely affect toughness when the particles are bonded together to form a metallurgical object, comprising heating the particles for transforming the regions at least sufficiently out of their metastable state to stabilize the regions and make the regions deformable, to improve toughness in deformed metallurgical objects formed by bonding the particles together, as compared to that achieved without the heating, said method further comprising bonding the particles into an object, and deforming the object.

12. A method as claimed in claim 11, the heating being sufficient to provide at least a 10% improvement in toughness.

13. A method as claimed in claim 11, the heating being sufficient to provide at least a 20% improvement in toughness.

14. A method as claimed in claim 11, the heating being sufficient to provide at least a 30% improvement in toughness.

15. A method as claimed in claim 11, the particles comprising an aluminum alloy.

16. A method as claimed in claim 15, the particles comprising an aluminum alloy of the class referred to as non-heat treatable.

17. A method as claimed in claim 7, the particles comprising a non-heat treatable aluminum alloy of the class referred to as dispersion hardened.

18. A method as claimed in claim 17, the alloy consisting essentially of 4 to 12% iron, 1 to 8% rare earth metal, balance aluminum.

19. A method as claimed in claim 18, the alloy consisting essentially of 6 to 10% iron, 2 to 8% cerium, balance aluminum.

20. A method as claimed in claim 4, the improvement in toughness being coupled with a less than 10% decrease in yield strength.

21. A method as claimed in claim 14, the improvement in toughness being coupled with a less than 10% decrease in yield strength.

22. A method of processing a metallurgical object containing heat-affected featureless regions sufficiently stabilized and deformable, such that deformation of the object results in improved toughness as compared to that achieved in the case of an otherwise equal object containing featureless regions which have not been heat-affected, said method comprising deforming said metallurgical object.

23. A method as claimed in claim 22, the achieved improvement in toughness being at least a 10% improvement.

24. A method as claimed in claim 22, the achieved improvement in toughness being at least a 20% improvement.

25. A method as claimed in claim 22, the achieved improvement in toughness being at least a 30% improvement.

26. A method as claimed in claim 25, the improvement in toughness being coupled with a less than 10% decrease in yield strength.

27. A method as claimed in claim 22, the object comprising an aluminum alloy.

28. A method as claimed in claim 22, the object comprising bonded powder.

29. A method as claimed in claim 28, the object comprising a dispersion hardened, bonded powder.

30. A method as claimed in claim 29, the alloy consisting essentially of 4 to 12% iron, 1 to 8% rare earth metal, balance aluminum.

31. A method as claimed in claim 30, the alloy consisting essentially of 6 to 10% iron, 2 to 7% cerium, balance aluminum.

32. A deformed metallurgical object containing heat-affected featureless regions sufficiently stabilized and deformable, such that the object has improved toughness as compared to that achieved in the case of an otherwise equal object containing featureless regions which have not been heat-affected.

33. An object as claimed in claim 32, the improvement in toughness being at least a 10% improvement.

34. An object as claimed in claim 32, the improvement in toughness being at least a 20% improvement.

35. An object as claimed in claim 32, the improvement in toughness being at least a 30% improvement.

36. An object as claimed in claim 35, the improvement in toughness being coupled with a less than 10% decrease in yield strength.

37. An object as claimed in claim 32, the object comprising an aluminum alloy.

38. An object as claimed in claim 32, the object comprising bonded powder.

39. An object as claimed in claim 38, the object comprising a dispersion hardened, bonded powder.

40. An object as claimed in claim 39, the alloy consisting essentially of 4 to 12% iron, 1 to 8% rare earth metal, balance aluminum.

41. An object as claimed in claim 40, the alloy consisting essentially of 6 to 10% iron, 2 to 7% cerium, balance aluminum.

42. A method of using metal particles containing heat-affected featureless regions sufficiently stabilized and deformable, such that deformation of an object formed by bonding the particles together results in improved toughness as compared to that achieved in the case of an otherwise equal object formed from particles containing featureless regions which have not been heat-affected, comprising bonding the particles to form an object and deforming the object.

43. A method as claimed in claim 42, the achieved improvement in toughness being at least a 10% improvement.

44. A method as claimed in claim 42, the achieved improvement in toughness being at least a 20% improvement.

45. A method as claimed in claim 42, the achieved improvement in toughness being at least a 30% improvement.

46. A method as claimed in claim 45, the improvement in toughness being coupled with a less than 10% decrease in yield strength.

47. A method as claimed in claim 42, the particles comprising an aluminum alloy.

48. A method as claimed in claim 47, the alloy comprising a dispersion hardened alloy.

49. A method as claimed in claim 48, the alloy consisting essentially of 4 to 12% iron, 1 to 8% rare earth metal, balance aluminum.

50. A method as claimed in claim 49, the alloy consisting essentially of 6 to 10% iron, 2 to 7% cerium, balance aluminum.

* * * * *

UNITED STATES PATENT AND TRADEMARK OFFICE

CERTIFICATE OF CORRECTION

PATENT NO. : 4,927,469

DATED : May 22, 1990

INVENTOR(S) : Roberto J. Rioja et al.

It is certified that error appears in the above-identified patent and that said Letters Patent is hereby corrected as shown below:

| | |
|---|---|
| Col. 1, line 11 | Change "Mettalurgical" to --Metallurgical--. |
| Col. 7, line 48<br>Claim 17 | Change "in claim 7" to --in claim 16--. |

Signed and Sealed this

Fifth Day of November, 1991

*Attest:*

HARRY F. MANBECK, JR.

*Attesting Officer*

*Commissioner of Patents and Trademarks*